US011123648B1

(12) United States Patent
Denoual

(10) Patent No.: US 11,123,648 B1
(45) Date of Patent: Sep. 21, 2021

(54) FIDGET TOY

(71) Applicant: Blue Orange Edition, Donville les Bain (FR)

(72) Inventor: Thierry Denoual, Donville les Bains (FR)

( * ) Notice: Subject to any disclaimer, the term of this patent is extended or adjusted under 35 U.S.C. 154(b) by 0 days.

(21) Appl. No.: 16/850,627

(22) Filed: Apr. 16, 2020

(51) Int. Cl.
*A63H 29/10* (2006.01)
*A63H 33/00* (2006.01)

(52) U.S. Cl.
CPC ..... *A63H 33/00* (2013.01)

(58) Field of Classification Search
CPC ..... A63H 33/00; A63F 7/3622; A63F 7/042
USPC ..... 446/168, 170; 119/707; 273/109; D30/160; 482/110, 44
See application file for complete search history.

(56) References Cited

U.S. PATENT DOCUMENTS 1,259,889 A * 3/1918 MacDonald ..... A63H 17/34 446/409
2,614,361 A * 10/1952 Marong ..... A63F 7/382 446/170
2,644,270 A * 7/1953 Marong ..... A63B 67/08 446/170
2,820,319 A * 1/1958 Marinsky ..... A63F 7/382 446/170
3,060,627 A * 10/1962 Seretny ..... A63B 67/08 446/170
3,185,479 A * 5/1965 Ortega ..... A63H 33/18 473/509
3,304,090 A * 2/1967 Morris ..... A63B 67/08 273/109
3,502,335 A * 3/1970 Sholin ..... A63F 7/04 473/588
3,626,633 A * 12/1971 Meyer ..... A63H 33/26 446/132
3,799,546 A * 3/1974 Gower-Rees ..... A63F 7/38 273/109
4,015,365 A * 4/1977 Stubbmann ..... A63H 1/20 446/258
4,036,491 A * 7/1977 Vierra ..... A63B 21/0608 482/105
4,042,244 A * 8/1977 Kakovitch ..... A63F 7/3622 273/109
4,356,915 A * 11/1982 Phillips ..... B65D 85/58 206/315.1
4,429,487 A * 2/1984 Taylor ..... A63B 21/0608 446/168
4,496,154 A * 1/1985 Shazeer ..... A63F 7/382 273/109
4,632,391 A * 12/1986 Orak ..... A63B 21/0608 446/170

(Continued)

OTHER PUBLICATIONS

Smooth-on, Durometer Shore Hardness Scale, uploaded Jan. 6, 2021, www.smooth-on.com/, 2 pages.*

*Primary Examiner* — Eugene L Kim
*Assistant Examiner* — Matthew B Stanczak

(57) ABSTRACT

A toy made from a hollow tube configured as a substantially circular toroid with an open center portion and an air gap defined by a segment of arc removed between an input end and an output end of the tube. The tube is shaped such that a ball sized to roll unimpeded through the hollow interior can be maintained in circulation by imparting a small parallel oscillatory motion with a hand when gripped by a user's fingers.

6 Claims, 5 Drawing Sheets

(56) References Cited

U.S. PATENT DOCUMENTS 4,722,299 A * 2/1988 Mohr ..... A01K 15/025 119/707
4,938,477 A * 7/1990 Kuervers ..... A63B 21/0608 482/105
5,009,193 A * 4/1991 Gordon ..... A01K 15/025 119/707
D335,553 S * 5/1993 Conner ..... D30/160
D335,554 S * 5/1993 Conner ..... D21/408
5,269,261 A * 12/1993 McCance ..... A01K 15/025 119/706
5,529,017 A * 6/1996 Udelle ..... A01K 15/024 119/706
5,540,187 A * 7/1996 Udelle ..... A01K 15/025 119/706
5,542,376 A * 8/1996 Udelle ..... A01K 15/025 119/707
5,667,221 A * 9/1997 Lievre ..... A63F 7/044 273/109
5,692,944 A * 12/1997 Pellicone ..... A63B 21/0608 446/170
5,809,938 A * 9/1998 Baiera ..... A01K 15/025 119/707
D405,563 S * 2/1999 Baiera ..... D30/160
5,924,908 A * 7/1999 O'Heir ..... A63H 33/00 119/707
6,019,712 A * 2/2000 Duncan ..... A63B 21/0004 446/168
D462,098 S * 8/2002 Fazeli ..... D21/456
6,485,349 B1 * 11/2002 Snyder ..... A63H 29/08 446/168
7,152,862 B1 * 12/2006 Chiu ..... A63F 7/044 273/109
7,367,565 B2 * 5/2008 Chiu ..... A63B 26/003 273/109
7,661,394 B2 * 2/2010 Plante ..... A01K 15/025 119/707
7,846,076 B2 * 12/2010 Salzwimmer ..... A63B 21/0624 482/110
7,882,788 B2 * 2/2011 Sorenson ..... A63F 7/3622 104/53
7,910,816 B2 * 3/2011 Glowacki ..... G10D 13/06 84/410
8,814,765 B2 * 8/2014 Bernstein ..... A63B 21/4035 482/110
D745,097 S * 12/2015 Webb ..... D21/682
9,591,832 B2 * 3/2017 Price ..... A01K 15/024
9,730,428 B1 * 8/2017 Kreischer ..... A01K 15/025
10,238,983 B1 * 3/2019 Polk ..... A63H 15/06
2002/0177507 A1 * 11/2002 Carbone ..... A63B 23/025 482/10
2005/0096200 A1 * 5/2005 Amann ..... A63B 21/22 482/110
2009/0095229 A1 * 4/2009 Plante ..... A01K 15/025 119/707
2012/0192806 A1 * 8/2012 Dixon ..... A01K 15/025 119/707
2012/0272921 A1 * 11/2012 Santarsiero ..... A63F 7/386 119/707
2014/0338613 A1 * 11/2014 Suring ..... A01K 15/025 119/707

* cited by examiner

FIDGET TOY

CROSS REFERENCES TO RELATED APPLICATIONS

Not applicable. The present application is a first-filed United States Non-Provisional Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

SEQUENCE LISTING

Not applicable.

BACKGROUND OF THE INVENTION

Field of the Invention

The present invention relates most generally to toys, and more particularly to a loop-and-ball spin-and-capture fidget toy.

Background Discussion

Fidgeting is restless movement not directed to carrying out a task at hand. In effect, fidgeting would appear to be useless. And the activity is not limited to children, as adults are also known to fidget, such as by nervously clicking a pen or finger coins or keys in a pocket. However, there may be a number of causes, including nervousness, frustration, boredom, or a neurodevelopment disorder, such as ADHD, and fidgeting can be conceived to be, at a minimum, an activity for relieving any such discomforts. Indeed, fidgeting has been promoted somewhat controversially as helping with focus or with the release of otherwise distracting nervous energy, and especially beneficial to children with ADHD, anxiety, or autism.

For instance, a 2015 article in The Journal of Abnormal Child Psychology by Sarver, et al, argues that hyperactive movements associated with ADHD can help people focus and learn better. [Sarver, D. E., Rapport, M. D., Kofler, M. J. et al. Hyperactivity in Attention-Deficit/Hyperactivity Disorder (ADHD): Impairing Deficit or Compensatory Behavior?. *J Abnorm Child Psychol* 43, 1219-1232 (2015). https://doi.org/10.1007/s10802-015-0011-1] Among the findings, the more complex and the higher the rate of activity, the better working memory performance for ADHD children. According to this view, certain kinds of fidget toys may be an effective intervention that enable non-disruptive hyperactivity and that overcome disruptive gross motor activity during learning and academic tasks.

That view does not stand uncontested: In 2018, Paul Graziano and a team of researchers concluded that children's use of fidget spinners negatively influence young children with ADHD's attentional functioning, even in the context of an evidence-based classroom intervention. [Graziano, P A, et al, To Fidget or Not to Fidget, That Is the Question: A Systematic Classroom Evaluation of Fidget Spinners Among Young Children with ADHD, *J Atten Disord.* 2020 January; 24(1):163-171. doi: 10.1177/1087054718770009. Epub 2018 Apr. 20.]

Whatever the outcome of the studies on the use of fidgeting devices, they now enjoy surprising popularity. Their use is widespread and enjoyed by many more than those who suffer attention deficit issues, anxiety, autism, or simply excess nervous energy.

An apocryphal story about the invention of the fidget spinner circulated in the early part of the present century. The claim was that Catherine Hettinger invented the spinner in 1993, and obtained a patent she could not afford to maintain. Evidently she has conceded that she did not invent the device. Regardless of its origin, however, the fidget spinner became an international gadget sensation and was nearly ubiquitous in schoolrooms and boardrooms.

But it was by no means the only fidget toy to come to market. Countless fidget toys have been developed. While the fidget spinner remains the most popular, other popular devices allegedly providing the same benefits include the ONO Roller by Ono; the OmniGrip by Pivot Performance; the Spiky Acupressure Massage Finger Ring by bA1 Sensory; the Gadget Addix 3 by Ztylus; the 12-Sided Fidget Cube by Twiddler Toys; the Flippy Chain by Pro-Noke; fidget beads by Begleri Normei; and the Stress Pad by WeFidget; and the Spinner Stick by Royew, to name only a few. Nearly all are marketed as a means to sharpen focus, but all equally disavow any claims to therapeutic efficacy: But they don't need that efficacy, as the items are inherently pleasurable to use for those even slightly inclined to fidgeting.

The foregoing products reflect the current state of the art of which the present inventor is aware. Reference to, and discussion of, these products is intended to aid in discharging Applicant's acknowledged duty of candor in disclosing information that may be relevant to the examination of claims to the present invention. However, it is respectfully submitted that none of the above-indicated products disclose and their associated promotional literature, teach, suggest, show, or otherwise render obvious, either singly or when considered in combination, the invention described and claimed herein.

BRIEF SUMMARY OF THE INVENTION

The present invention is a toy for enjoyably burning off nervous energy; it is a source of enjoyment. As noted, early studies suggest fidget toys may actually enhance focused attention and increase working memory performance during learning activities. But setting aside the potential therapeutic effects of using such devices, they can be just plain fun. The present invention is directed to that end: engaging entertainment. And the present inventor makes no claims to providing a therapeutic device, but to the extent that the present invention shares features characteristic of fidget toys purportedly capable of beneficial use in a learning environment, the present invention is also offered as a means to that end.

The present invention is a truncated hollow tubular loop in a substantially circular toroidal configuration. The truncation (a removed segment of tube of about 40 degrees of arc) forms an air gap across which a moving ball travels during use. The toy is sized for gripping between a user's thumb and index finger, possibly supplement by a middle finger. When a user imparts a small and regular parallel oscillation movement of sufficient force, a ball inserted into the toy travels in a circular path against the inner wall of the tube along the circumferential ring bisecting the tube in hemispherical halves. The moving ball can be visualized as it passes elongate windows disposed on the one or more sides of the tube as well as when the ball travels across the air gap.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
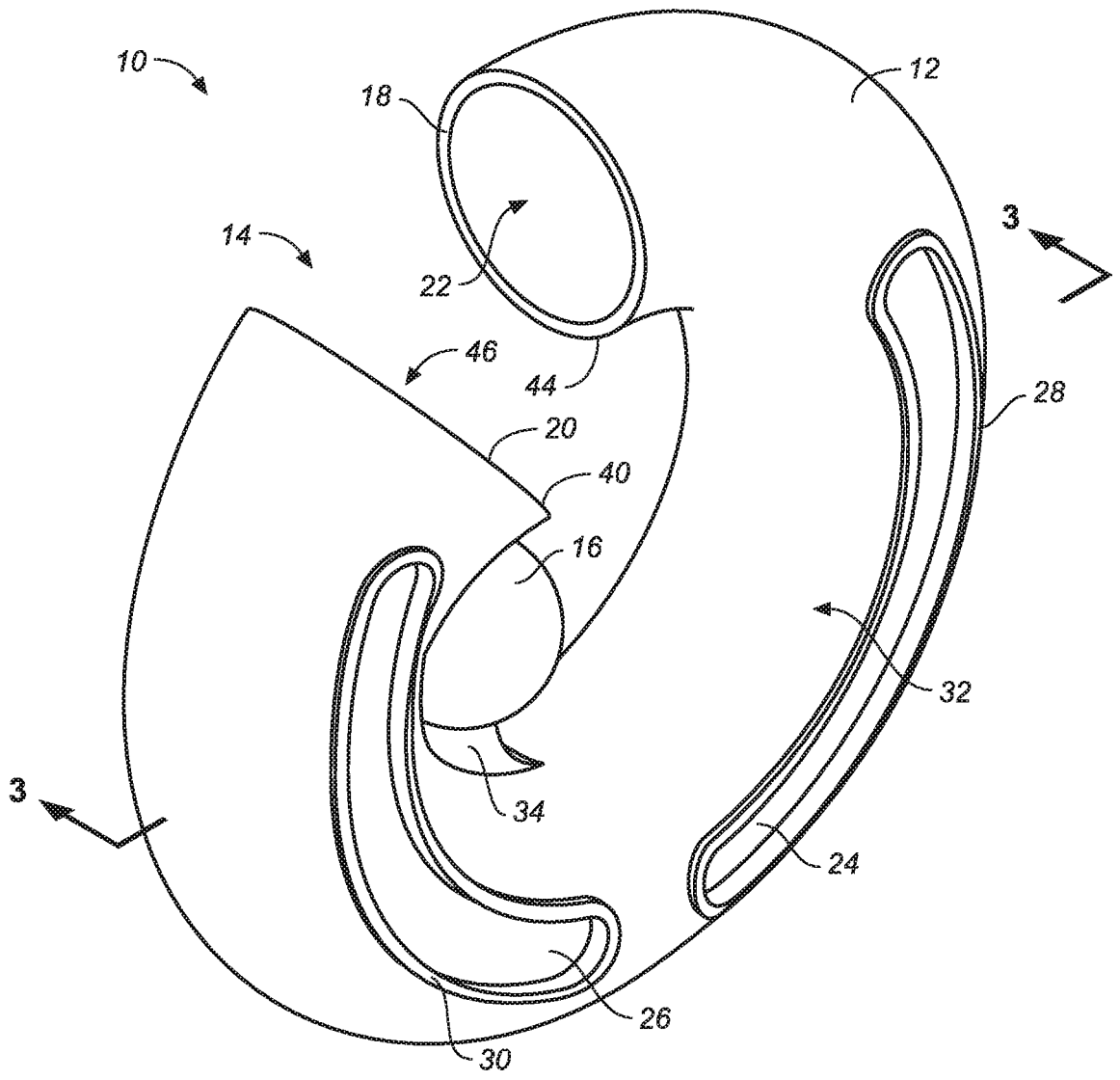
FIG. 1 is an upper left perspective view of the fidget toy of the present invention.
Figure 2:
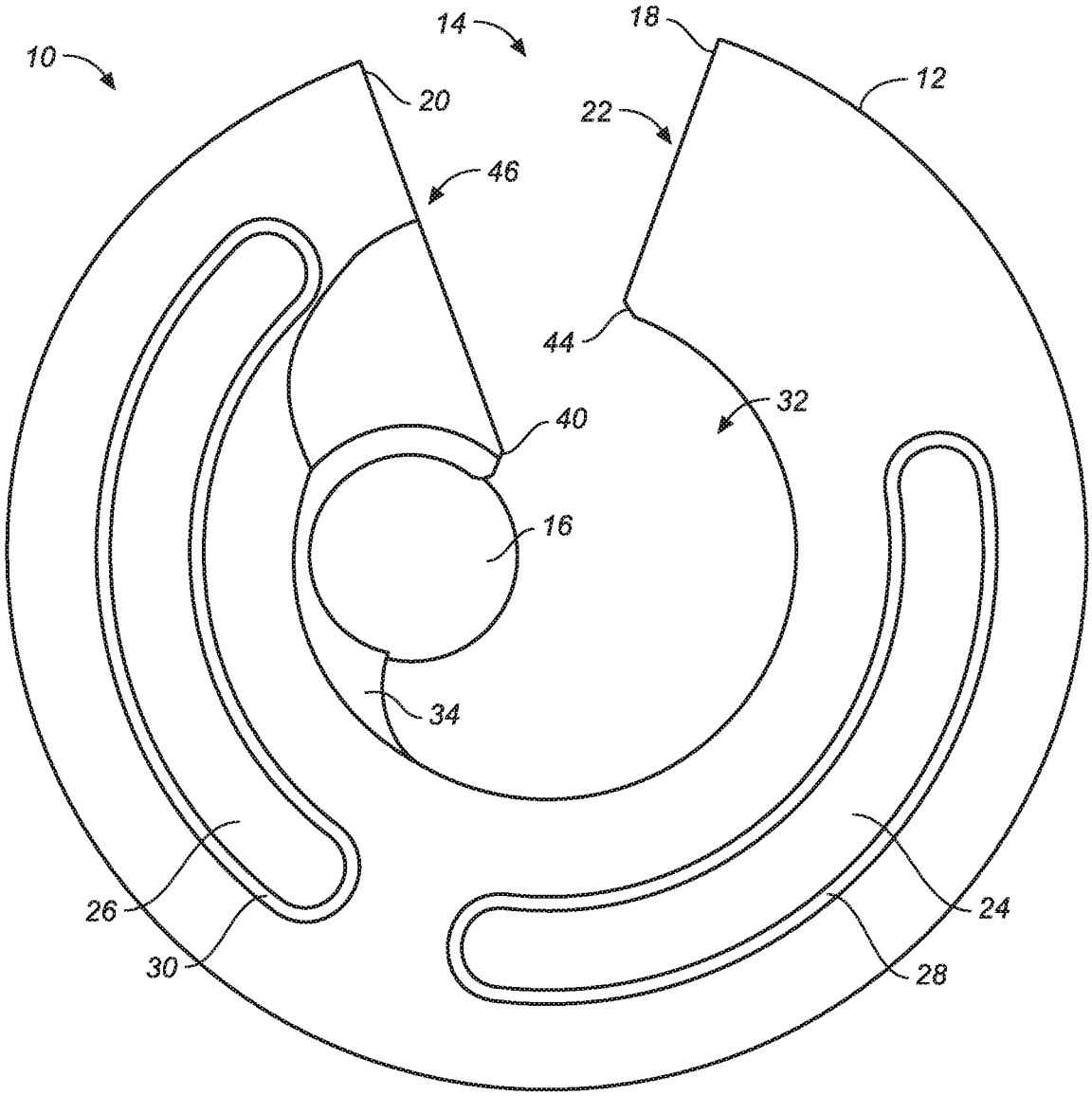
FIG. 2 is a left side view in elevation thereof.
Figure 3:
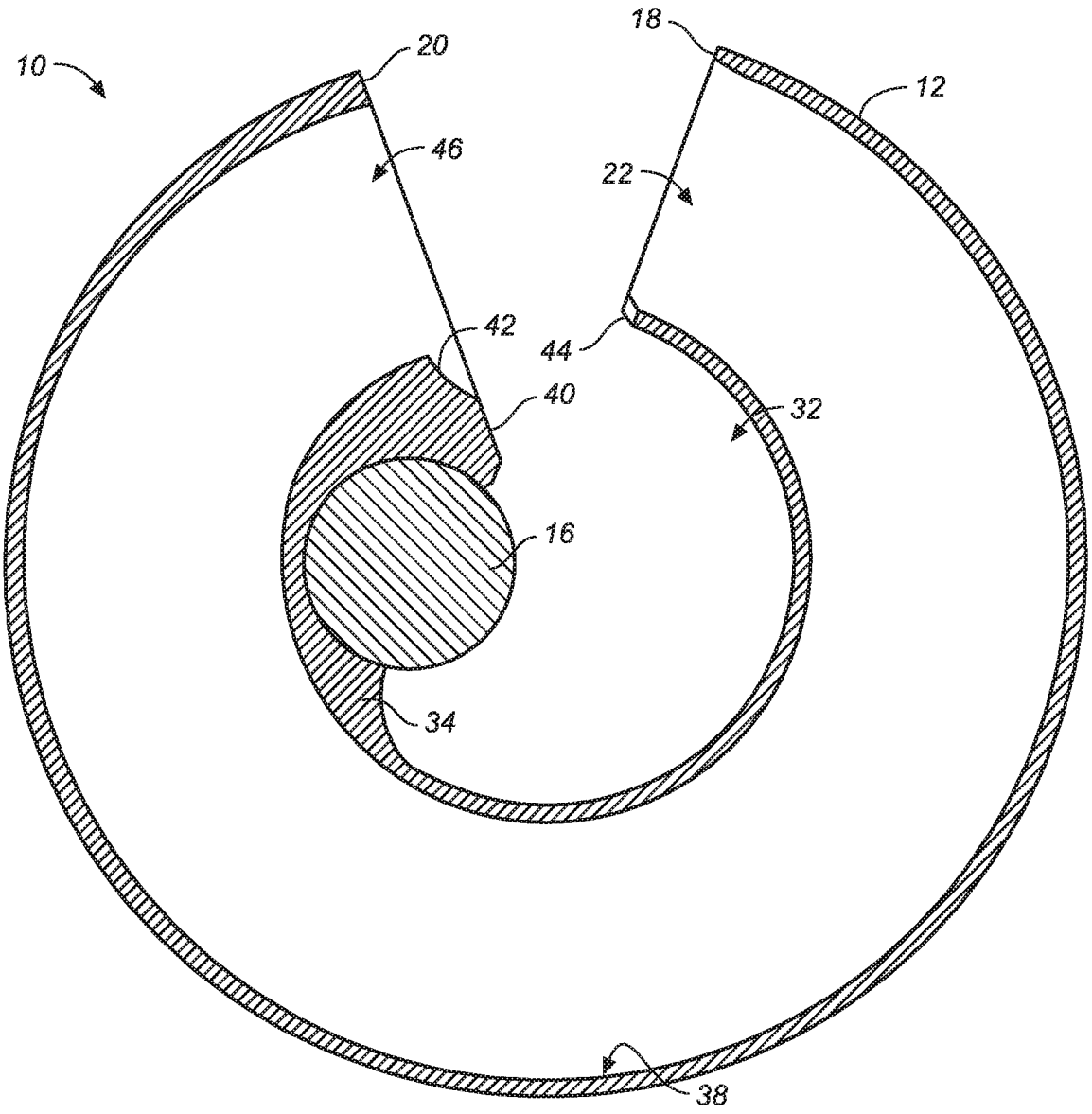
FIG. 3 is a cross-sectional left side view in elevation taken along section line 3-3 of FIG. 1.
Figure 4:
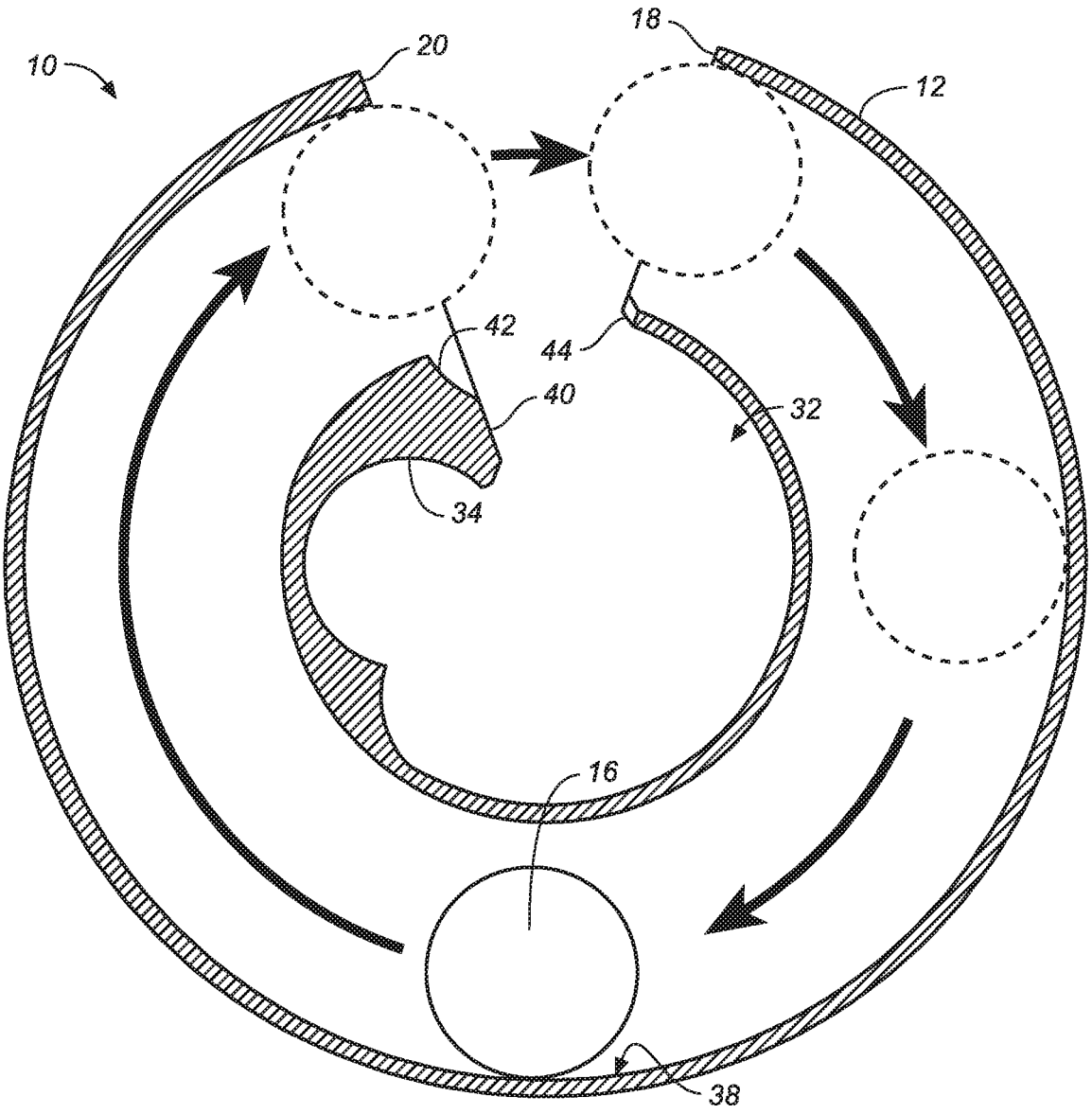
FIG. 4 is the same view, showing the path of a ball circulating within the toy.

Referring to FIGS. 1 through 5, wherein like reference numerals refer to like components in the various views, there is illustrated therein a new and improved fidget toy, generally denominated 10 herein.

In an embodiment, the inventive toy is a hollow tubular loop 12 in a substantially circular (ring) toroidal configuration with a segment or arc 14 removed for the insertion of a ball 16 sized to roll unimpeded through the hollow interior of the tube. Thus, the truncated torus includes a first (input) end 18 and a second (output) end 20, ordered according to the direction of travel of a ball inserted into the opening 22 of the first end. That is, and referring now especially to FIG. 3, when used the ball travels from the input end to the output end, exits the output end and flies across the gap 14 between the output end and input end before entering the input end for a repeat loop around the tube interior.

The tubular loop includes elongate arcuate side windows 24, 26 on at least one side to facilitate viewing of the ball as it travels, each window opening circumscribed with a raised rim 28, 30, to facilitate grip and handling. The central interior opening 32 of the loop (i.e., the "donut hole" when the toy is considered as a solid torus) may include an integral feature comprising a hemispherical recess 36 describing slightly more than 180 degrees of arc and sized to function as a ball holder. The ball is preferably slightly resilient so as to compress and deform slightly when inserted into the holder. (See FIGS. 2-3) The ball fits easily into the tube at the opening 22 of the input end 18, and in embodiments is optimally between 70-90% the inner diameter of the tube, most preferably approximately 80% that diameter. Further, performance improves with ball hardness. Thus, a ball having between 55 Shore A and 75 Shore D hardness is desirable, with the optimal hardness on the higher end of the useful range.

While generally circular in cross section, the tube and circular loop are configured with dimensions that facilitate ease of use and nearly flawless delivery of the ball across the gap with minimal skill. Indeed, the skill required to circulate the ball comprises nothing more than gentle wrist motions—almost exclusively flexion and extension—to provide a parallel oscillatory input of force on the toy to generate the reactionary centrifugal force needed to drive the ball against the interior wall 38 of the tube and along the longitudinal circumferential ring that divides the tube in hemispherical halves.

As can be seen, the input end 18 is a generally circular opening, while the output end 20 includes an interiorly oriented flared portion 40 having a shaped recess 42 spaced apart from the lower edge 44 of the input end 18 so as to provide a second space in which to capture and hold the ball. The output opening 46 of the output end is thus expanded and shaped so as to minimize the chance of interfering with ball movement and deflecting it off course for direct (flying) insertion into the opening 22 of the input end 18.

Figure 5A:
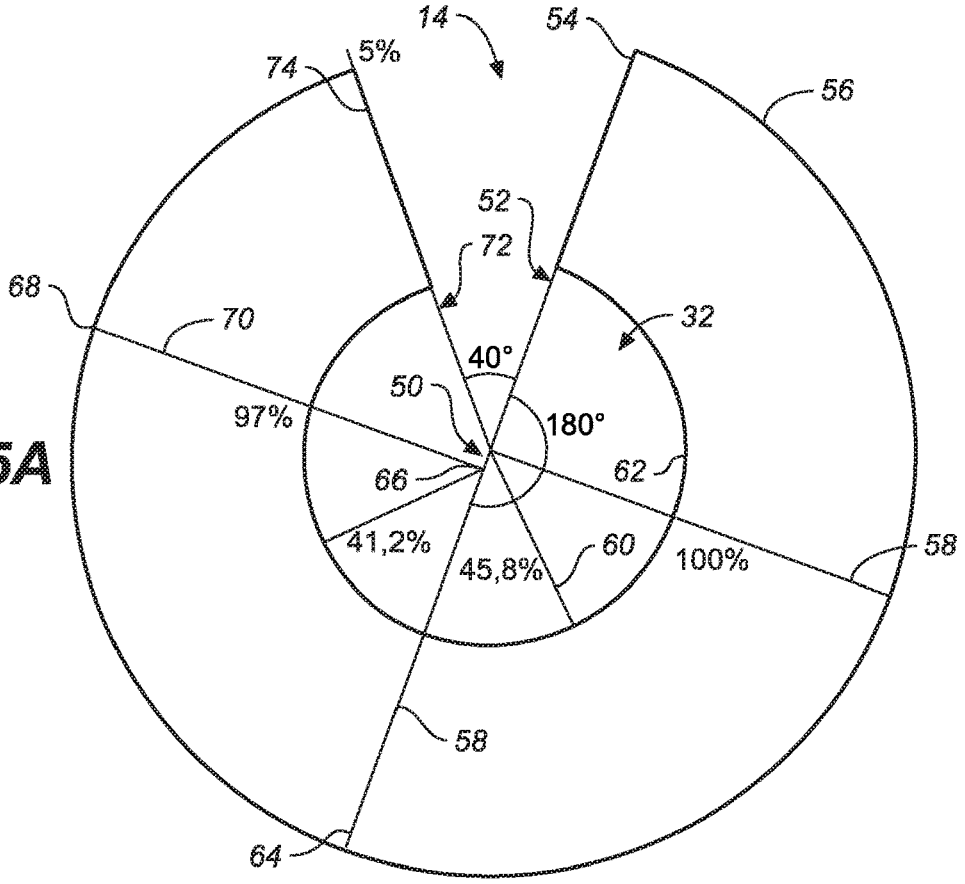
FIG. 5A is a schematic view showing the exterior dimensions of the tubular loop.
Figure 5B:
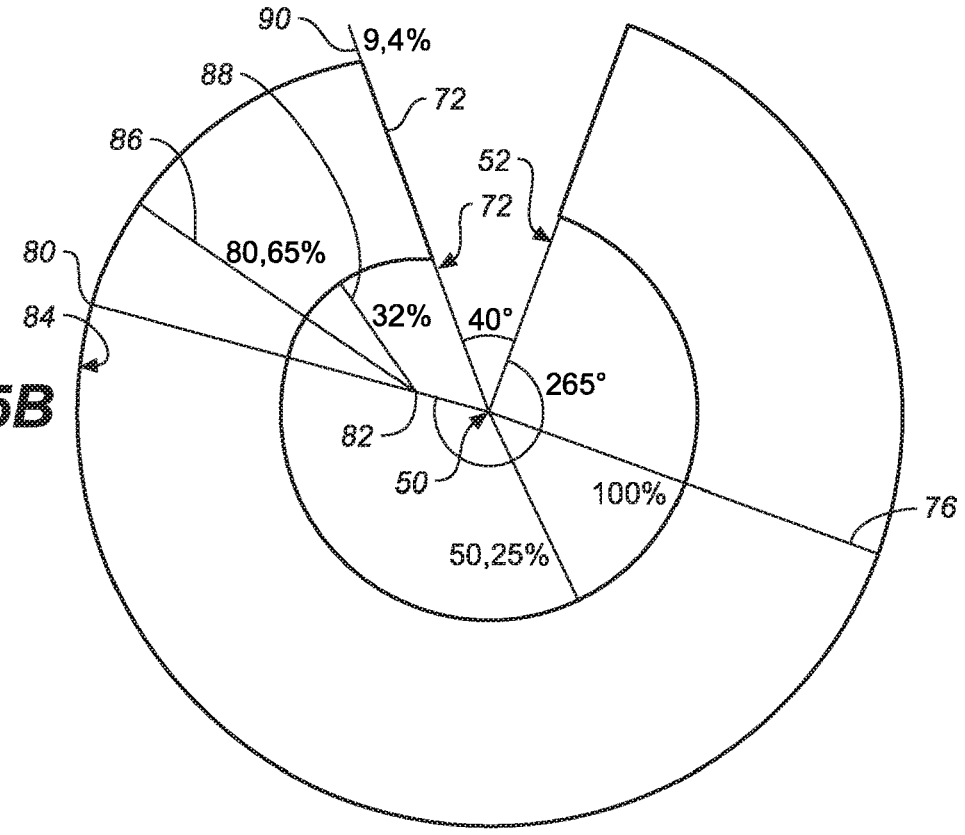
FIG. 5B is a schematic view showing the interior dimensions of the tubular loop.

A reader with skill in the art will readily surmise, and FIGS. 5A-5B clearly show, that the optimal configuration for the tubular loop for smooth ball movement, launch, flight, and tube reentry is not a simple circle, nor does it include a simple and uniform tube thickness. Rather, careful consideration is given to all of the features of the tube geometry. Specifically, and referring now to FIGS. 5A and 5B, the exterior dimensions of the tube are defined from a geometric center 50 and a datum reference plane defined by the plane 52 of the inlet opening rim 54. The outermost dimension 56 of the tube's exterior surface may be considered to be 100% of the longest outer major radius 58 from the geometric center through 180 degrees of arc as measured from the datum plane 52. By contrast, the minor radius 60 of the innermost dimension, i.e., the innermost exterior surface 62 of the tube defining the area of the circular opening 32 is 45.8% of the major radius through 180 degrees of arc. The major and minor radius each begin decreasing in length at approximately 180 degrees of arc.

More specifically, at 180 degree of arc 64 the geometric center shifts to a point 66 along the datum reference plane away from the inlet end which is 41.2% of the major radius 58, and the arc of the tube, both outermost and innermost, begin curving steadily inwardly, such that at 270 degrees of arc 68 the major radius 70 in this portion of arc is 97% of the 100% major radius, and at the plane 72 of the rim 74 at the outlet opening 20 the major radius 74 has diminished to 95% of the 100% major radius 58. It will be seen that the gap 14 comprises 40 degree of arc.

The interior dimensions of the toroidal tube include an inner major radius 76 measured from the geometric center 50 and a minor radius 78 which is 50.25% of the length of the major radius, both of which sweep 265 degrees of arc from the datum reference plane 52. At 265 degrees 80 the radius center shifts along the major radius at the 265 degree point to a point 82 measured from the surface of the inner wall 84 which is 80.65% 86 the length of the inner major radius 76, at which point the minor radius 88 decreases to 32% of the inner major radius, thereby bending the interior surfaces inwardly. At the plane of the 74 of the outlet opening 20, the major radius 90 as measured from the geometric center is 90.6% of the length of the major radius at the datum reference plane 52.

From this it can be seen that at 265 of arc, the inner wall begins a gentle inward curvature that forms a ramp portion (increased curvature interiorly) that drives the ball slightly inwardly as it traverses this portion of the tube, and to thereby offset the lack of a constraining tube structure that would keep the ball arcing around the center over the gap portion 14. The ball is thereby launched slightly inwardly relative to its overall curved path defined by the tube curvature immediately inside the opening 22 of the inlet end 18.

In embodiments, the gap (or truncated segment) 14 comprises about 40 degrees of arc as measured from the geometric center 50. With ball dimensions considered, as well as those of the interior tube diameter, this angular measure is From the foregoing, it is seen that in its most essential aspect, the fidget toy of the present invention is a hollow tube configured as a substantially circular toroid with an open center portion and an air gap defined by a segment of arc removed between an input end and an output end of the tube. The tube is shaped such that a ball sized to roll unimpeded through the hollow interior can be maintained in circulation by imparting a small parallel oscillatory motion with a hand when gripped by a user's fingers.

In embodiments, the inventive toy includes a tube in a substantially circular toroidal configuration with an open center portion and a segment of arc removed between an input end and an output end, said tube having a cylindrical hollow interior; and a ball sized to roll unimpeded through said hollow interior.

In embodiments, the toy includes elongate arcuate side windows.

In embodiments, the input end is circular in cross section and the output end includes a flared portion having a shaped recess which is spaced apart from a lower edge of the input end so as to form a ball holder.

In embodiments, the toroidal configuration includes a major radius and a minor radius, and the major radius at the output end is smaller than the major radius at the input end.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A fidget toy, comprising:

a hollow tube having a cylindrical hollow interior and a toroidal configuration with an open center portion and a geometric center in said open center portion, wherein the truncation defines an air gap disposed between an input end and an output end of said hollow tube and wherein said toroidal configuration includes a variable major radius and a variable minor radius, and wherein said variable major radius at said output end is smaller than said variable major radius at said input end, said variable minor radius at said output end is smaller than said variable minor radius at said input end, and said inlet end has an inlet opening rim defining a datum reference plane intersecting said geometric center, and said variable major radius and said variable minor radius begin decreasing at a point 180 degrees of arc or greater from said datum reference plane; and a ball sized to roll unimpeded through said hollow interior.

2. The fidget toy of claim 1, further including at least one elongate arcuate side window open on a side of said hollow tube.

3. The fidget toy of claim 2, including two elongate arcuate side windows open on at least one side of said hollow tube.

4. The fidget toy of claim 3, further including a raised rim circumscribing each of said elongate arcuate side windows.

5. The fidget toy of claim 1, wherein said input end is circular in cross section and said output end includes a flared portion.

6. The fidget toy of claim 5, further including a shaped recess disposed in said flared portion and spaced apart from a lower edge of said input end so as to provide a space in which to hold said ball.

* * * * *